US006161258A

United States Patent [19]

Stahlecker

[11] Patent Number: 6,161,258

[45] Date of Patent: Dec. 19, 2000

[54] SPINNING MACHINE HAVING A PLURALITY OF SPINNING STATIONS

[75] Inventor: Hans Stahlecker, Haldenstrasse 20, 73079 Suessen, Germany

[73] Assignees: Fritz Stahlecker, Bad Überkingen; Hans Stahlecker, Süssen, both of Germany

[21] Appl. No.: 09/369,336

[22] Filed: Aug. 6, 1999

[30] Foreign Application Priority Data

Aug. 26, 1998 [DE] Germany ..... 198 38 762

[51] Int. Cl.[7] ..... D01H 5/74

[52] U.S. Cl. ..... 19/286; 19/150; 19/244; 19/246

[58] Field of Search ..... 19/150, 236–245, 19/247–250, 252, 263, 286, 287, 288, 304–308; 57/304, 315

[56] References Cited

U.S. PATENT DOCUMENTS

| | | | |
|---|---|---|---|
| 5,090,192 | 2/1992 | Stahlecker | 57/315 |
| 5,157,911 | 10/1992 | Stahlecker et al. | 57/315 |
| 5,228,281 | 7/1993 | Stahlecker | 57/315 |
| 5,243,813 | 9/1993 | Stahlecker | 57/315 |
| 5,600,872 | 2/1997 | Artzt et al. . | |
| 5,647,196 | 7/1997 | Wassenhoven | 57/304 |

*Primary Examiner*—John J. Calvert
*Assistant Examiner*—Gary L. Welch
*Attorney, Agent, or Firm*—Evenson, McKeown, Edwards & Lenahan, P.L.L.C.

[57] ABSTRACT

An arrangement for condensing a drafted fiber strand is arranged at each spinning station of a spinning machine. The condensing arrangements each comprise a transport surface which transports the fiber strand over a suction slit of a suction device. A joint suction device having its own fan is provided for a certain number of spinning stations so that differences in underpressure between the individual spinning stations are avoided to a great extent.

39 Claims, 4 Drawing Sheets

SPINNING MACHINE HAVING A PLURALITY OF SPINNING STATIONS

BACKGROUND AND SUMMARY OF THE INVENTION

This application claims the priority of German application 198 38 762.8, filed in Germany on Aug. 26, 1998, the disclosure of which is expressly incorporated by reference herein.

The present invention relates to a spinning machine having a plurality of spinning stations, which each have an arrangement for condensing a drafted fiber strand, which arrangement comprises a transport surface for guiding the fiber strand over a suction slit of a suction device.

A spinning machine of this type is prior art for example in U.S. Pat. No. 5,600,872. In the case of such spinning machines a central suction channel is provided, which extends over all spinning stations, whereby a suction connection is provided for each arrangement for condensing. In particular in the case of long spinning machines, there is the risk that the vacuum at those spinning stations which are further away from the vacuum generating fan falls off, resulting in differences in quality of the yarns to be spun.

It is an object of the present invention to avoid inadmissable differences in underpressure and thus to avoid differences in yarn quality.

This object has been achieved in accordance with the present invention in that a plurality of suction devices, each provided for a respective plurality of spinning stations, are provided, a fan being provided for each of the suction devices.

The suction devices can be provided for a higher or lower number of spinning stations, according to the size of the fans or the form of the spinning machine. As a result of the short path from each fan to the individual spinning stations, throttling losses and underpressure differences are minimized. Thus differences in quality in the yarn to be spun can be reduced to a permissible level.

For the purpose of the present invention, each suction device including its fan is provided for a plurality of spinning stations of both machine sides. For example, a joint fan can be provided for eight spinning stations of each machine side.

In preferred embodiments of the present invention, the suction devices comprise hollow profiles, which are provided with suction slits according to the number of spinning stations being serviced thereby, said hollow profiles serving as sliding guides for sieve belts comprising the transport surfaces.

According to the number of suction devices, including the fan, which are present, a hollow profile is provided for the same number of spinning stations, said hollow profile having for each spinning station a suction slit, but for all spinning stations arranged thereto only one suction opening, which can be connected to a suction tube of the suction device.

The hollow profile, extending along a plurality of spinning stations, can be sealed clamped onto the respective suction tube by means of a snap lock. This serves in particular for the exchange of a sieve belt when it is worn.

In a further development of preferred embodiments of the present invention, a joint used-air channel is provided for all the suction devices. This ensures that the unavoidable suctioned-off fiber fly on the condensing arrangements does not reach the individual components of the spinning machine.

In order to monitor the vacuum, and thus the yarn quality, a pressure measuring device is preferably arranged for each suction tube so that the vacuum can be regulated for the purpose of the invention. In the case of a malfunction, the relevant machine section is shut down.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
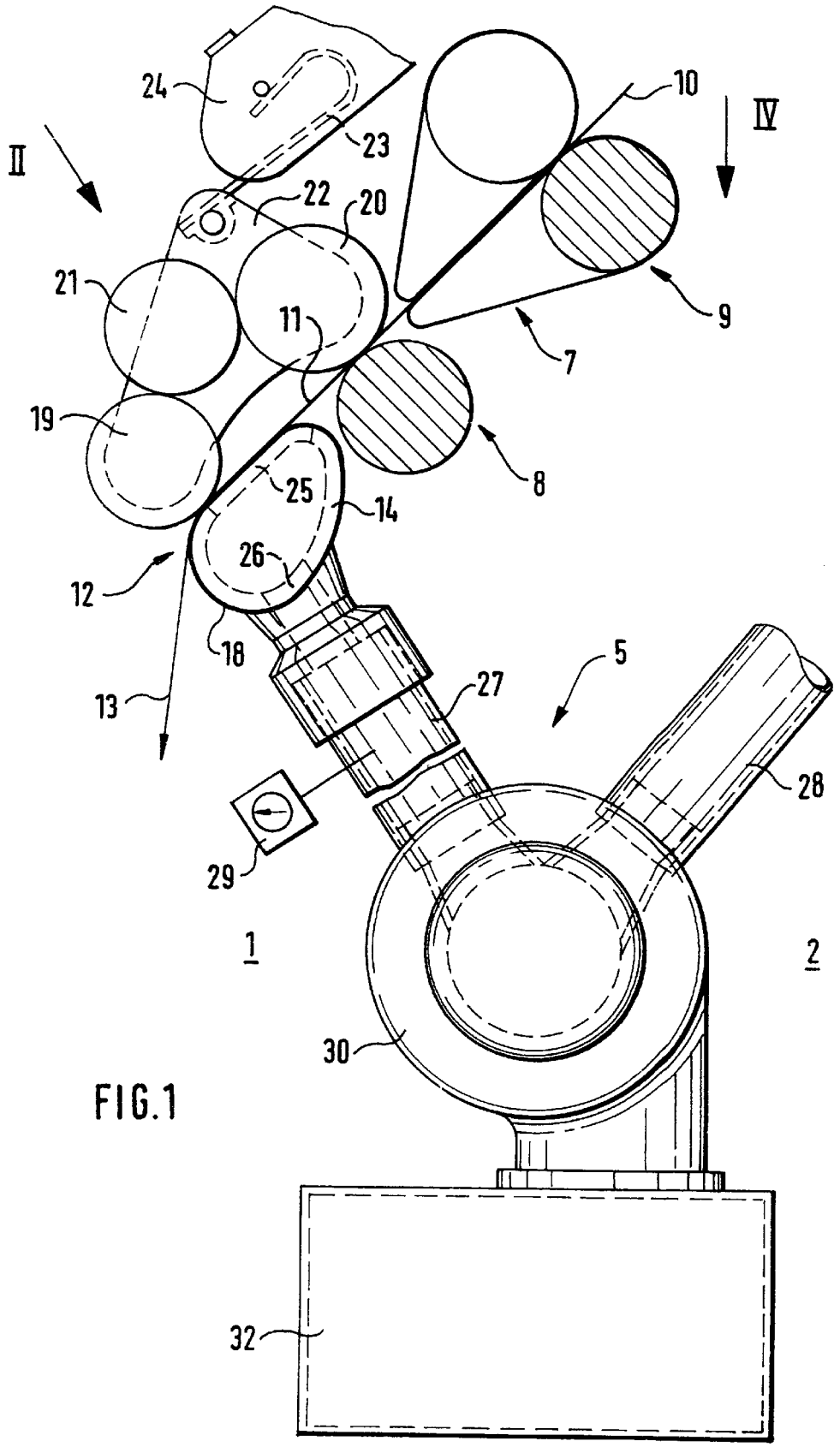
FIG. 1 is a part sectional side view of a spinning station in the area of the arrangement for condensing a drafted fiber strand, constructed in accordance with a preferred embodiment of the present invention.

The spinning machine shown in the FIGS. 1 to 4 is preferably, but not necessarily a ring spinning machine. On each of the two machine sides 1 and 2, a plurality of spinning stations 3 are arranged in a row adjacently to one another. Each spinning station 3 comprises preferably a spindle 4, which can be designed as a ring spindle. For a certain number of spinning stations 3 a suction device 5 or 6 is provided, whose function is described below.

Figure 2:
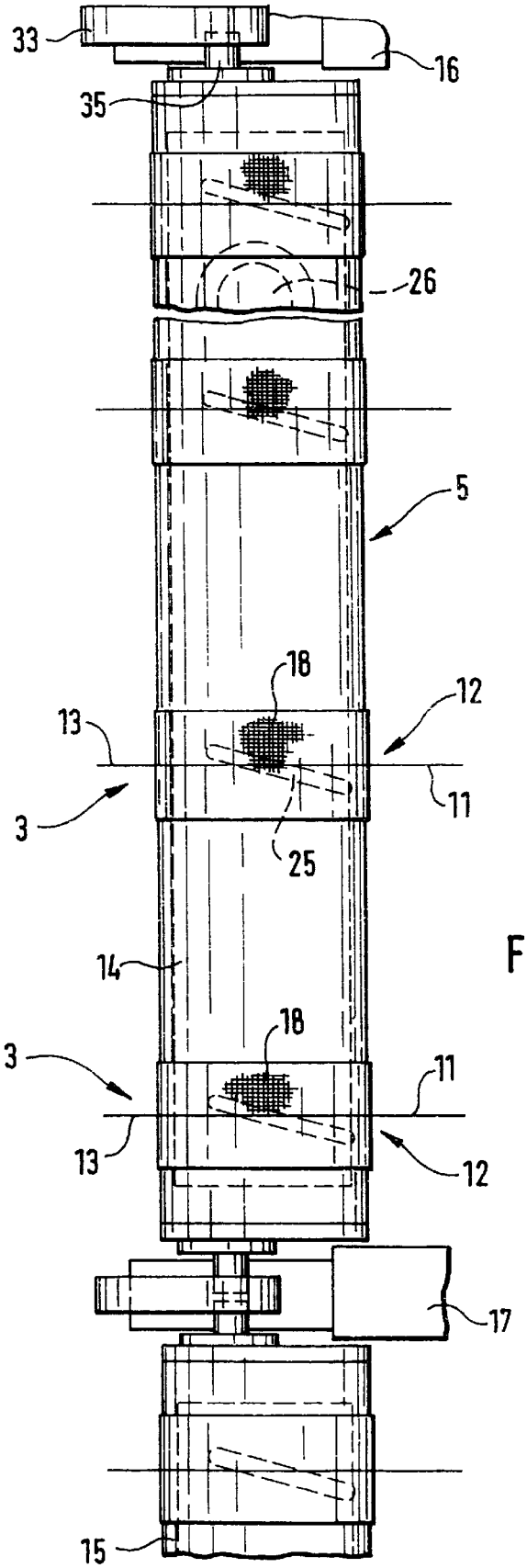
FIG. 2 is a view in the direction of the arrow II of FIG. 1 onto the arrangement for condensing a drafted fiber strand, which arrangement extends along a plurality of spinning stations.

Referring to FIGS. 1 and 2, a drafting unit 7 for each spinning station 3 can be seen, of which drafting unit 7 only the front roller pair 8 as well as the apron roller pair 9 arranged upstream thereof are shown. In the drafting unit 7, a sliver or a roving 10 is drafted to a desired fineness in a known way. The ready drafted fiber strand 11 is pneumatically condensed in an arrangement 12 directly downstream of the drafting unit 7, which results in an improved cross sectional utilization and reduced hairiness of the thread 13 to be spun, which becomes more tear resistant and more even. Downstream of the arrangement 12, the thread 13 to be twisted travels according to the denoted arrow direction to a respective spindle 4.

A hollow profile 14 or 15 is provided for a plurality of spinning stations 3, for example a section of eight spinning stations 3, which hollow profile 14 or 15 is a component part of the arrangement 12 for condensing as well as the suction devices 5 or 6. In this case, a low-friction profile of light metal or stainless steel can be used, or alternatively a slideable plastic profile having a high wear resistance can be used for the hollow profile 14, 15. This hollow profile 14 or 15 is closed on all sides, except for the openings which are described below, and is subject to a vacuum. Each hollow profile 14,15 is supported at its ends in a way described below in roller stands 16,17, in which the bottom cylinders of the drafting unit 7 are also supported.

The hollow profile 14 or 15 is designed as a sliding guide for a plurality of sieve belts 18, of which one each is provided for a respective spinning station 3. Two hollow profiles 14 disposed opposite one another of two different machine sides 1 and 2 belong to a joint suction device 5 or 6. In the case of the sieve belt 18, a very fine woven belt having an extremely fine perforation is involved, whereby the sieve belt 18 is air permeable. It serves as a transport surface for the fiber strand 11 to be condensed.

At a distance from the front roller pair 8, for example at a distance corresponding to the staple length, each sieve belt 18 is pressed against the hollow profile 14 by means of a driven nipping roller 19. A relatively low pressure of, for example, 20 Newton is sufficient for this purpose. The sieve belt 18 is driven thus in a sliding manner relating to the hollow profile 14, and the sieve belt 18 in turn transports the drafted fiber strand 11.

The drive of the nipping roller 19 is derived from the front top roller 20 of the front roller pair 8. By means of a transfer roller 21, which is disposed by means of friction on the front top roller 20 on the one hand and on the nipping roller 19 on the other hand, the fiber strand 11 to be condensed attains approximately the same speed as at the nipping line of the front roller pair 8. A slight tension draft can be obtained by choosing a relevant friction diameter.

The front top roller 20 as well as the nipping roller 19 are arranged in a rocker 22, which is loaded by means of a loading spring 23 of the top weighting arm 24. The corresponding geometry ensures that the loading of the front top roller 20 is higher than the loading of the nipping roller 19.

According to the number of spinning stations 3, for which a hollow profile 14 or 15 is provided, the hollow profile 14 comprises a corresponding number of suction slits 25, which are each covered by a sieve belt 18. The suction slits 25 begin directly downstream of the nipping line of the front roller pair 8 and extend to the nipping line of the nipping roller 19. The suction slits 25 extends at an angle of approximately 20° transversely to the transport direction, so that the drafted fiber strand 11 transported over the suction slit 25 is imparted a slight false twist, which supports the condensing effect.

A suction opening 26 is arranged for each hollow profile 14 or 15 approximately in the center between the roller stands 16 and 17, which suction opening 26 is connected to a vacuum source. Only one single suction opening 26 is present per hollow profile 14 or 15. Each suction opening 26 can be connected in a sealed way to a suction tube 27 or 28. The hollow profile 14 is applied in a releasable way at the separation point between the suction opening 26 of the hollow profile 14 and the respective suction tube 27 or 28, in a way to be described below.

A pressure measuring device 29 for monitoring the vacuum necessary for spinning is arranged at each suction tube 27,28.

A fan 30 or 31 is provided for each suction device 5 or 6, so that one fan 30,31 is present per machine section. The fan 30,31 is however advantageously arranged to service both machine sides 1 and 2 jointly, so that also two hollow profiles 14 and 15 are arranged for one fan 30 or 31. The used air of the individual fans 30,31 as well as further fans (not shown) is fed into a joint used-air channel 32, which advantageously extends in the center plane along the length of the entire spinning machine. This prevents fiber fly suctioned at the transport surface of the sieve belt 18 from reaching any components of the machine.

Figure 3:
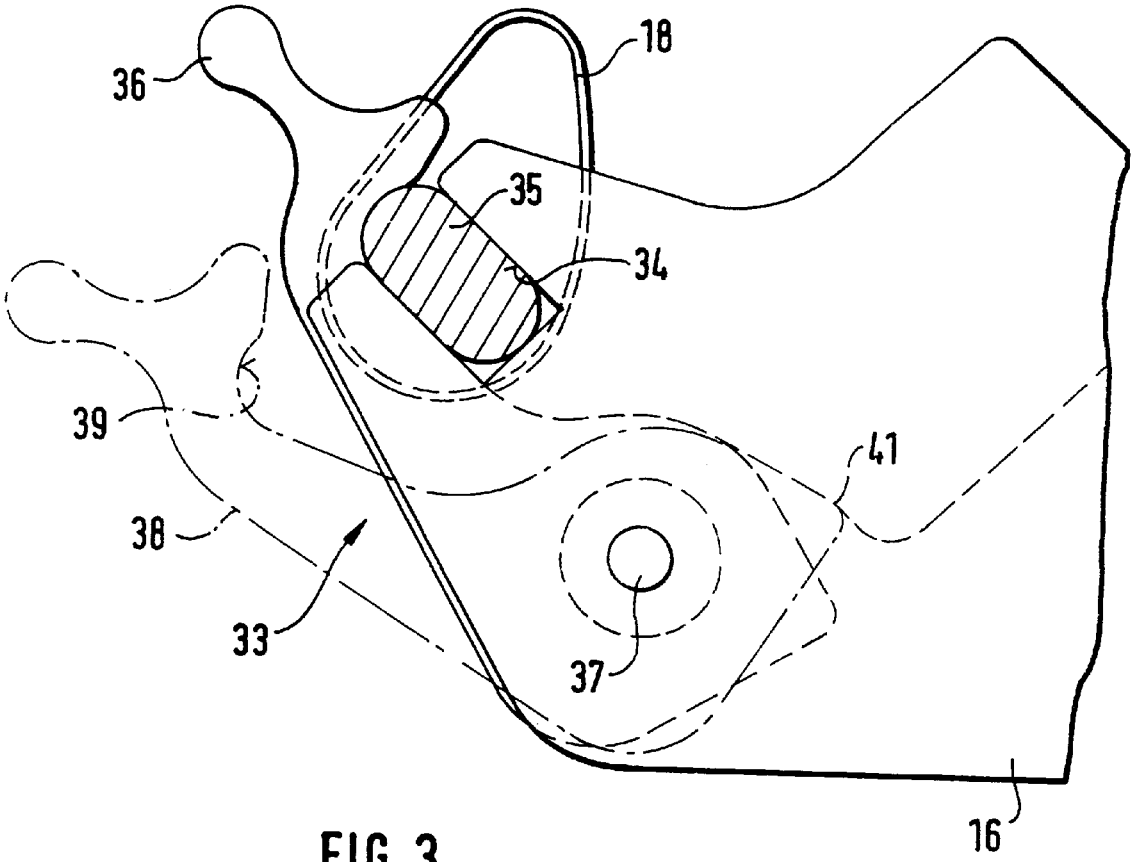
FIG. 3 is side view of FIG. 1 in the area of the arrangement for condensing having a snap lock for exchanging the arrangement.

As denoted only in FIG. 1, and clearly seen in FIG. 3, each hollow profile l4,15 is supported in the respective roller stands 16 and 17 by means of snap locks 33 applied to its ends. In FIG. 3, the end of a roller stand 16 as well as the sieve belt 18, shown separately, of a spinning station 3 can be clearly seen. The roller stands 16,17 are provided with corresponding take-ups 34 having rectangular cross-sections, which take the form of recesses open at the top and in which corresponding holding pegs 35 are inserted, which are located at the ends of the hollow profiles 14,15. The holding pegs 35 are matched to the contour of the take-ups 34, said holding pegs 35 being oval or half-cylindrical in shape at their ends. By means of a clamping lever 36 the hollow profiles 14,15 can be fixed by means of their holding pegs 35 in the take-ups 34 of the roller stands 16,17.

The individual clamping levers 36 can be swivelled around a swivel axle 37 of the respective roller stand 16,17 until they reach a limit stop 41. The disengaged position 38 of the clamping lever 36 is denoted by a dot-dash line. The clamping surface 39 can be seen with which the clamping lever 36 is disposed over the corresponding contour of the holding peg 35 when engaging. Self-locking thus occurs.

The snap-locks 33 serve the rapid exchange of a hollow profile 14 or 15, when, for example, a sieve belt 18 of a spinning station 3 is worn or defect. In order to replace a sieve belt 18, the clamping lever 36 is guided over into its disengaged position 38, so that the relevant hollow profile 14 or 15 can be removed upwards out of the take-up 34 of the respective roller stands 16 and 17. The old sieve belt 18 can now be easily replaced by a new sieve belt 18. The hollow profile 14,15 is inserted again into the roller stands 16 and 17 and locked by means of the clamping lever 36.

Figure 4:
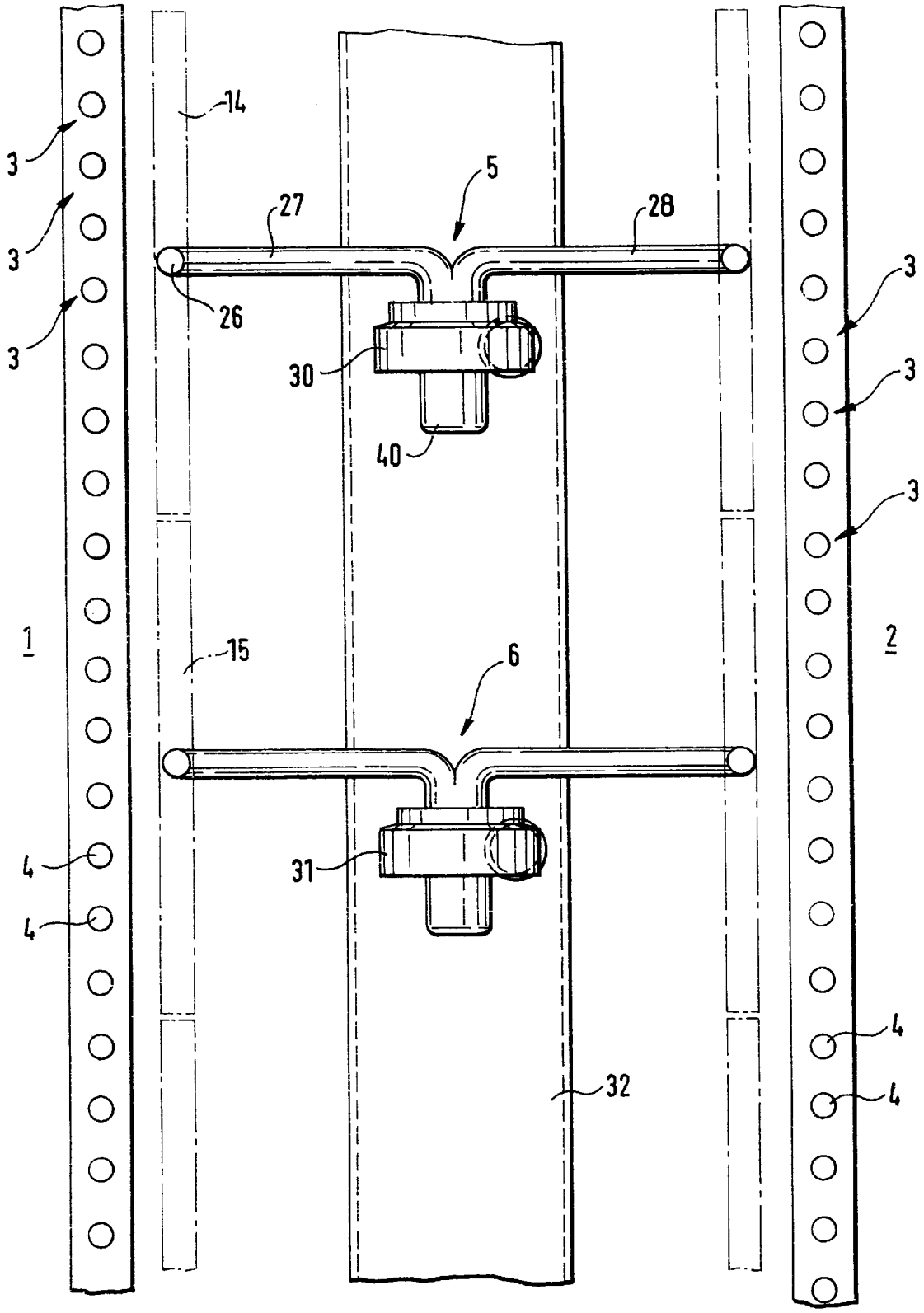
FIG. 4 is in reduced scale a schematic view in the direction of the arrow IV of FIG. 1 to demonstrate how the individual suction devices are arranged to the spinning stations of the spinning machine.

In FIG. 4, it is shown schematically and in reduced scale how a suction device 5 or 6 is provided for a plurality of spinning stations 3. Each suction device 5,6 is connected to two hollow profiles 14 or 15 disposed opposite on different machine sides 1,2.

The suction openings 26, the suction tubes 27,28, the fans 30,31 as well as the used-air channel 32 can be seen in FIG. 4. In addition, a small electric motor 40 is provided for each fan 30,31. Alternatively, all fans 30,31 can be driven by a continuous drive shaft extending in machine longitudinal direction.

As can be seen, one suction device 5 or 6 is provided for each section of eight spinning stations 3 per machine side 1 and 2. By means of this distribution, the vacuum can be homogenized along the spinning stations 3, in particular in the case of long spinning machines. It is not then necessary to provide a separate vacuum channel having particularly large dimensions for the arrangement 12 for condensing of the drafted fiber strand 11.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A spinning machine having a plurality of spinning stations, which each have a condensing arrangement for condensing a drafted fiber strand, which condensing arrangement comprises a transport surface for guiding the fiber strand over a suction slit of a suction device in a condensing zone disposed downstream of a drafting unit and having a fiber strand nipping point at a downstream end of the condensing zone which is operable to prevent fiber strand twist applied downstream of the nipping point being transferred to the condensing zone, wherein a plurality of suction devices are provided, each suction device being operably connected to a plurality of spinning stations, and wherein a fan is provided for each of the suction devices.

2. A spinning machine according to claim 1, wherein each suction device including a respective fan is arranged jointly for a plurality of spinning stations of both machine sides.

3. A spinning machine according to claim 2, wherein the suction devices comprise hollow profiles, which are provided with a number of suctions slits according to the number of spinning stations associated therewith, which hollow profiles serve as sliding guides for sieve belts comprising said transport surfaces.

4. A spinning machine according to claim 3, wherein each hollow profile comprises a joint suction opening for all suction slits of the hollow profile, which suction opening can be connected to a suction tube of the suction device.

5. A spinning machine according to claim 4, wherein the hollow profile can be clamped in a sealed way to the respective suction tube by snap-locks.

6. A spinning machine according to claim 2, wherein a joint used-air channel is provided for all of said suction devices.

7. A spinning machine according to claim 1, wherein the suction devices comprise hollow profiles, which are provided with a number of suctions slits according to the number of spinning stations associated therewith, which hollow profiles serve as sliding guides for sieve belts comprising said transport surfaces.

8. A spinning machine according to claim 7, wherein each hollow profile comprises a joint suction opening for all suction slits of the hollow profile, which suction opening can be connected to a suction tube of the suction device.

9. A spinning machine according to claim 8, wherein the respective hollow profile can be clamped in a sealed way to the respective suction tube by snap-locks.

10. A spinning machine according to claim 9, wherein a joint used-air channel is provided for all of said suction devices.

11. A spinning machine according to claim 9, wherein a pressure measuring device is provided for each suction tube.

12. A spinning machine according to claim 8, wherein a joint used-air channel is provided for all of said suction devices.

13. A spinning machine according to claim 12, wherein a pressure measuring device is provided for each suction tube.

14. A spinning machine according to claim 8, wherein a pressure measuring device is provided for each suction tube.

15. A spinning machine according to claim 7, wherein a joint used-air channel is provided for all of said suction devices.

16. A spinning machine according to claim 1, wherein a joint used-air channel is provided for all of said suction devices.

17. A spinning machine according to claim 1, wherein suction is applied to said condensing arrangements by respective fans, a plurality of said fans being driven by a common drive unit.

18. A spinning machine according to claim 17, wherein said drive unit includes a continuous drive shaft extending in a machine longitudinal direction.

19. A spinning machine comprising:

a plurality of adjacent spinning stations, each of said spinning stations including a fiber strand condensing assembly disposed upstream of respective yarn twist applying units, each said condensing assembly forming a condensing zone disposed downstream of a drafting unit and having a fiber strand nipping point at a downstream end of the condensing zone which is operable to prevent fiber strand twist applied downstream of the nipping point from being transferred to the condensing zone, wherein each of said fiber strand condensing assemblies includes a suction slit and a transport member operable to transport the respective fiber strand over the associated suction slit, and wherein suction is applied to respective groups of said condensing assemblies by respective separate suction devices for each group, each suction device including a respective fan.

20. A spinning machine according to claim 19, wherein said spinning stations are disposed at two oppositely facing sides of the machine, and wherein the respective groups of condensing assemblies are associated with spinning stations at both of said sides of the machine.

21. A spinning machine according to claim 20, wherein each suction device includes a hollow profile member with a respective suction slit for each spinning station which in use is operably connected with said suction device.

22. A spinning machine according to claim 19, wherein each suction device includes a hollow profile member with a respective suction slit for each spinning station which in use is operably connected with said suction device.

23. A spinning machine according to claim 19, wherein a plurality of said fans are driven by a common drive unit.

24. A spinning machine according to claim 23, wherein said drive unit includes a continuous drive shaft extending in a machine longitudinal direction.

25. A suction system operable to apply suction to fiber strand condensing arrangements at spinning stations of a spinning machine having a plurality of adjacent spinning stations, each condensing arrangement forming a condensing zone disposed downstream of a drafting unit and having a fiber strand nipping point at a downstream end of the condensing zone which is operable to prevent fiber strand twist applied downstream of the nipping point being transferred to the condensing zone, said suction system comprising:

a plurality of suction devices which each include a fan and are operably connectable to a plurality of suction slits at a corresponding plurality of said spinning stations.

26. A suction system according to claim 25, wherein said spinning stations are disposed at two oppositely facing sides of the machine, and wherein the respective groups of condensing assemblies are associated with spinning stations at both of said sides of the machine.

27. A suction system according to claim 26, wherein each suction device includes a hollow profile member with a respective suction slit for each spinning station which in use is operably connected with said suction device.

28. A suction system according to claim 25, wherein each suction device includes a hollow profile member with a respective suction slit for each spinning station which in use is operably connected with said suction device.

29. A suction system according to claim 25, wherein a plurality of said fans are driven by a common drive unit.

30. A suction system according to claim 29, wherein said drive unit includes a continuous drive shaft extending in a machine longitudinal direction.

31. A spinning machine having a plurality of spinning stations, which each have a condensing arrangement for condensing a drafted fiber strand, which condensing arrangement comprises a transport surface for guiding the fiber strand over a suction slit of a suction device, wherein a plurality of suction devices are provided, each suction device being operably connected to a plurality of spinning stations, wherein a fan is provided for each of the suction devices, and wherein the suction devices comprise hollow profiles, which are provided with a number of suction slits according to the number of spinning stations associated therewith, which hollow profiles serve as sliding guides for sieve belts comprising said transport surfaces.

32. A spinning machine according to claim 31, wherein each hollow profile comprises a joint suction opening for all suction slits of the hollow profile, which suction opening can be connected to a suction tube of the suction device.

33. A spinning machine according to claim 32, wherein the respective hollow profiles can be clamped in a sealed way to the respective suction tube by snap-locks.

34. A spinning machine according to claim 32, wherein a joint used-air channel is provided for all of said suction devices.

35. A spinning machine according to claim 32, wherein a pressure measuring device is provided for each suction tube.

36. A spinning machine according to claim 32, wherein a joint used-air channel is provided for all of said suction devices.

37. A spinning machine having a plurality of spinning stations, which each have a condensing arrangement for condensing a drafted fiber strand, which condensing arrangement comprises a transport surface for guiding the fiber strand over a suction slit of a suction device, wherein a plurality of suction devices are provided, each suction device being operably connected to a plurality of spinning stations, wherein a fan is provided for each of the suction devices, and wherein a joint used-air channel is provided for all of said suction devices.

38. A spinning machine comprising:

a plurality of adjacent spinning stations, each of said spinning stations including a fiber strand condensing assembly disposed upstream of respective yarn twist applying units, each said condensing assembly forming a condensing zone disposed downstream of a drafting unit and having a fiber strand nipping point at a downstream end of the condensing zone which is operable to prevent fiber strand twist applied downstream of the nipping point from being transferred to the condensing zone, wherein each of said fiber strand condensing assemblies includes a suction slit and a transport member operable to transport the respective fiber strand over the associated suction slit, and wherein suction is applied to said condensing assemblies by respective fans, a plurality of said fans being driven by a common drive unit.

39. A spinning machine according to claim 38, wherein said drive unit includes a continuous drive shaft extending in a machine longitudinal direction.

* * * * *